US005319952A

United States Patent [19]

Cadney

[11] Patent Number: 5,319,952

[45] Date of Patent: Jun. 14, 1994

[54] ROLL FORMING MACHINE

[75] Inventor: Stephen H. Cadney, Didsbury, England

[73] Assignee: Arletti Limited

[21] Appl. No.: 20,574

[22] Filed: Feb. 22, 1993

[30] Foreign Application Priority Data

Feb. 21, 1992 [GB] United Kingdom ..... 9203777
Dec. 11, 1992 [GB] United Kingdom ..... 9225864

[51] Int. Cl.[5] ..... B21D 5/08

[52] U.S. Cl. ..... 72/181; 72/178; 72/247

[58] Field of Search ..... 72/180–182, 72/178, 247

[56] References Cited

U.S. PATENT DOCUMENTS

| | | | |
|---|---|---|---|
| 2,176,115 | 10/1939 | Yoder | 72/181 |
| 3,006,224 | 10/1961 | Celovsky | 72/181 |
| 3,886,779 | 6/1975 | McClain | 72/181 |
| 4,117,702 | 10/1978 | Foster . | |
| 4,269,055 | 5/1981 | Sivachenko | 72/181 |
| 4,558,577 | 12/1985 | Trishevsky | 72/181 |

FOREIGN PATENT DOCUMENTS

| | | | |
|---|---|---|---|
| 26163 | 3/1984 | Australia . | |
| 00337 | 6/1986 | Japan . | |
| 651872 | 3/1979 | U.S.S.R. | 72/181 |
| 299710 | 12/1989 | U.S.S.R. | 72/247 |
| 477590 | 6/1937 | United Kingdom . | |
| 2188859 | 10/1987 | United Kingdom . | |

OTHER PUBLICATIONS

W. G. Kirkland, "Cold Forming Practice in the United States", Nov. 1959, Iron and Steel Engr. pp. 134–149.

M. A. Wallis, "A Survey of Sheet Metal Cold Roll Forming" The Corp. Labs, British Steel Corp., MW/36/71, Table of Contents & pp. 1–10.

*Primary Examiner*—Daniel C. Crane

*Attorney, Agent, or Firm*—Frank Benasutti

[57] ABSTRACT

A roll forming machine is used for forming material, typically metal strip into various shapes. The machines comprise pairs of forming rolls which are spaced apart along an axis. The profile of the roll pairs progressively change along the axis, so that respective pairs of rolls effect different degrees of folding to material passing between them. As a result, the machine is capable of effecting progressive folding of material fed between the pairs of rolls along this axis. In the present machines, versatility of the machines is improved by using forming rolls each comprising a plurality of roll section elements. The roll section elements are mounted so as to be independently freely revolvable about the axis of the roll and additionally they may be driven so that they are capable of assisting both in folding/forming roll material and in transmitting drive thereto. The roll elements are mounted such that they may be moved aside and up and down into various positions for the purpose of altering the forming roll profile and so altering the profile of the formed end product, without the need to replace the roll elements with others of a different shape.

9 Claims, 6 Drawing Sheets

ROLL FORMING MACHINE

BACKGROUND OF THE INVENTION

1. Field of Invention

This invention relates to roll forming; a technique of progressively and continuously folding material by means of successive pairs of profiled rolls, the rolls in each pair being described as "bottom rolls and top rolls" respectively. The roll pairs are also known as stages, stands or passes. Rolls in the successive pairs have a different profile to effect differing degrees of folding of material passing between them. In use, material is fed into a roll forming machine at one end between the pairs of rolls, either as cut as sheets or in coil material, and is progressively folded by the successive pairs of rolls in a series of discrete steps to emerge at the other end of the machine formed about the feed axis. The rolls in the pairs may both form and drive the raw material through the machine. The material most commonly formed is steel, but non-ferrous metals and other materials are formed by this method.

2. Description of the Prior Art

A comprehensive background for the roll forming technique is provided by, for example, "Cold Forming", W. G. Kirkland, Iron and Steel Engineer, November, 1959 and "A Survey of Sheet Metal Cold Roll Forming", M. A. Wallis, British Steel Corporation Corporate Laboratories Paper Number MW/36/71.

A schematic illustration of such a conventional roll forming machine is shown in the accompanying FIG. 1. (The figure shows only a selection of roll pairs and the usual roll supports are omitted for the sake of clarity. In the machine, driven forming roll pairs are mounted so that each roll in a pair is rotatable about a generally horizontal axis. Adjacent roll pairs have slightly differing profile so as to effect correspondingly differing degrees of folding to material passing through the machine, from the roll pair 139 towards roll pair 140.

In addition to the driven forming roll pairs 139, 140, the machine may also include auxiliary rolls 141, which are normally undriven and often rotate about an axis arranged at an angle to the horizontal axis of the main driven rolls. Such auxiliary rolls allow access to parts of the material which are not accessible by the driven forming rolls. Also use of such auxiliary rolls may be advantageous in preventing scuffing of the raw material. Typically, the auxiliary rolls are more readily adjustable than the main driven rolls.

As previously discussed, on such known roll forming machines the profiles of the roll pairs mounted in the machine determine the formed shape of the product and thus the roll pair must be made specifically for a particular shape, size and thickness of product. Thus, adaptation of a machine to form a product of different shape, or size or to accommodate anything more than minor raw material thickness alteration requires a change of bottom and/or top rolls.

This is disadvantageous because a change or roll pairs may take many hours as the new set of roll pairs may require some setting. Additionally, the roll pairs are usually made from hardened alloy steel to high degrees of accuracy and each set is designed individually and may take some weeks to manufacture. As a result, many man hours of labor are required to make the average set of roll pairs.

The cost of a set of roll pairs means that the product to be produced will have to be made in high volume to justify both the initial roll pair cost and also the roll change and setting time.

In recent years a number of techniques have been employed in the attempt to improve machine versatility and production flexibility by seeking to reduce roll change and setting times. In essence these techniques enable a quick change from one predetermined machine section to another. For example, such techniques may involve the removal of a complete set of roll pairs, still mounted on their stands and shafts, known as a 'raft' and the substitution of another complete raft. See, for example, the accompanying FIG. 2 in which the roll pairs are mounted on a base comprising a fixed part 145 and a removable part 146. Repositioning of part 146 on part 145 is typically assisted by way of pegs indicated generally at 147.

Such a 'raft' method is usually used for producing wide panels where production runs are very high and the roll sets are large and more costly than average.

Also another variation is to mount individual roll pairs, their shafts and stand onto a plate. This assembly, known as a 'cassette', can be changed for another cassette. An example cassette assembly is illustrated in FIG. 3. Here again the roll pairs are mounted on a removable base part 148. This time the part 148 is divided into sections; one for each roll pair. Repositioning of the removable part 148 on fixed part 145 is again assisted by way of pegs 147.

There is also the method of having two sub-sets of roll pairs mounted on cantilevered or overhung shafts facing each other and which together make one forming set on two 'heads'. The heads can be pivoted about a vertical axis and other roll sets brought into play if similar cantilevered roll sets are mounted on the horizontally opposing side of the heads. This is illustrated schematically in FIG. 4.

A further technique, similar in principle, mounts sets of top and bottom rolls on a type of carousel about a horizontal axis. A change of rolls is achieved by indexing the top and bottom carousel by a portion of one rotation. A second predetermined roll set then comes into play. This latter method usually has the disadvantage of not being able to drive the raw material at the same time as forming it. Other rolls must be provided to drive the material.

The techniques outlined above seek to avoid the removal of individual rolls in the roll pairs from shafts and subsequent fitting of others. They also rely on the rolls in the pairs being designed to take account of a predetermined change from one product shape to another and therefore allow the machine to be adaptable for forming products within a limited range of shapes and sizes. Essentially, the aforementioned methods provide for quicker changes between pre-determined configurations.

Australian patent AU-B-26163/84, Applicant John Lysagne (Australia) Ltd. entitled "Roll-forming Machine", shows how axial movement may be accomplished and no device is shown now any movement at right angles to it may be carried out. Moreover, the removable roll segment is limited to being slideably mounted on the same shaft as a fixed roll segment. The pedestal axial movement provided then moves the pair of roll segments. The roll segment is therefore not truly independent.

The axial adjustment that is provided for the slideable roll segment is mounted on the shaft carrying the roll segment and is therefore not suitable for remote adjustment. The means of adjusting the slideable roll segment rotates with the roll shaft and cannot be connected to an adjuster nor can the machine be adjusted at this point while the roll rotates.

The pedestal movement is adjustable but not readily suitable to automatic adjustment since the pedestal once moved must be clamped by a second means. This is a mechanism that is only suited to manual adjustment involving clamping and unclamping between adjustment.

In UK Patent Application, GB 2188 859 A, date of filing Apr. 9, 1987, Applicant Hayes Engineering Ltd., there is no provision for roll movement up or downwards. The rolls are termed roll elements but in no way can they be segmented to the extent required for change in the formed profile that is not a series of pre-determined forms. The alterations that can be accomplished are limited to a variation in profile width and in the orientation of the profiles at each end. The example of forming shown is that described in our application under the term 'air-bending'. This is where the variation in leg lengths up the formed angle are not controlled by any restraining part of a roll profile.

U.S. Pat. No. 4,117,702, Inventor Gene N. Foster, Assignee The Boeing Company, Seattle, dated Oct. 3, 1978, describes a pinch or pyramid forming machine and not a roll forming machine which has sequential pairs of rolls arranged along an axis. Its propose is to curve a pre-formed and straight profile into a curved profile.

The machine described shows how roll movement is to be carried out in a direction transverse to the rotation axis, i.e. towards the center of curvature of the formed product. No means is shown for moving the rolls in a direction parallel to the center of curvature of the formed product as would be necessary for true flexibility. The reference to rolls being able to move along one or more forming axes refers to rolls mounted on axes at an angle to one another.

A person familiar with the art of roll forming could not adapt this principle to the pairs of rolls required for roll forming of products from flat strip as is described in our application. The reason for this is the lack of a mechanism for moving roll segment in both x and y axes and for a mechanism that does this and allows the type of interlacing of roll segments needed that we show with the simultaneous possibility of providing drive to the formed product.

The manufacture of conventional roll pairs can be made more economical by splitting an individual roll up into pieces, allowing the roll to be dismantled and some of the pieces re-assembled and securely fixed together to provide a profiled roll having a different configuration by addition of other suitable pieces. Also as regards economy, it has recently become possible to assist the roll design process by specialized Computer Aided Design Software. This has enabled designer to produce drawings more quickly and manufacturers have been able to take advantage of the design data in electronic form. Economy of the method has, therefore, been improved, but not dramatically.

A final alternative is the so called "air-bending" method, which, for example, can be used to vary the leg lengths of channel shapes by leaving the ends of the legs unrestrained by 'traps' (a face against which the end of the strip lies). Unfortunately, this method risks inaccurate leg lengths on the product where parts of the roll profile are not used to control material movement.

Despite the above work, the roll forming technique remains one in which, if product quality and dimensional accuracy are to be retained, individual roll pair shape or profile is fixed and to change this profile requires removal of top and/or bottom rolls from the shaft or rotation of a larger assembly. The present invention seeks to overcome at least some of the aforementioned disadvantages.

SUMMARY OF THE INVENTION

In one broad aspect, the invention provides a roll forming machine containing at least one roll pair comprising a plurality of roll section elements, at least some of said elements being remotely, and preferably independently, axially displaceable, or otherwise capable of positional adjustment by remote means to alter the profile of the said at least one roll pair.

An arrangement in which elements, typically in the form of roll sections are arranged to be independently displaceable, for example, about a longitudinal axis of a roll in a roll pair is advantageous. This is because it allows a roll pair to adopt numerous profiles, or geometry, say depending upon spacing between adjacent roll elements or by raising or lowering a roll element for example. Similarly, adjusting position of corresponding elements adjacent roll pairs allows variation in the degree of folding or forming effected as the raw material passes between those roll pairs.

In another broad aspect the aforesaid elements may also be displaceable along an axis at an angle to the roll axis(es) and/or rotated about an axis at an angle to the roll axis(es) to further alter the profile of the said at least one roll pair.

In another broad aspect, the present invention provides a roll forming machine containing a roll pair comprising a plurality of roll section elements, at least some of said elements being independently rotatable about an axis in or near to the plane of the roll pair and preferably such rotation being remotely actuable. Such an arrangement is advantageous since these rotatable elements may be operable to transmit varying degrees of drive to a raw material and assist its passage through the machine. Different degrees of drive may also be effected by employing means capable of selectively driving alternative elements at different speeds. In this regard, the plane of the roll pair in an imaginary plane which passes through the top and bottom rolls and the material where, in use, it contacts facing surfaces of the respective rolls.

As appropriate, a roll in a roll pair may comprise elements which are rotatably mounted on a shaft, arranged along a longitudinal axis of that roll, for example. Control means may be actuable to drive at least some selected elements to rotate freely about the shaft to thereby transmit drive to a raw material passing over/under the rolls in the pair. Rotation of other selected elements need not be actuated by the control means so that they act to assist forming of the raw material rather than transmitting drive thereto. Preferably each roll element is capable of performing one or more of the tasks of forming and controlling the position of the raw material. If desired, control means may be operable to selectively drive at least some roll elements which are arranged medially, that is towards the center, of a roll.

In another broad aspect, the invention also provides a roll forming machine for forming raw material passing therethrough, containing a roll pair comprising a plurality of separate rolling and forming roll section elements, preferably each of which said elements is capable of performing one or more of the tasks of forming and controlling the position of the raw material.

Another aspect is the provision of such sectioned rolls for use in a roll forming machine.

Embodiments of the present invention aim to make a number of things possible:

1) The critical individual roll shape elements are adjustable. The fulcrum around which the material is folded to produce a bend in the material, or the 'trap' to control an edge, can be moved in relation to each other and other elements in very small steps as compared with rolls currently available. This may amount to, for normal commercial purposes, provision of almost infinite variation in roll profile;
2) With this arrangement it is possible to retain the option to drive the raw material at the same time or leave the roll un-driven as required.

It is therefore possible to produce different size products of various thicknesses merely by moving elements of the roll pairs within the overall assembly, and thereby obtain an almost infinite variation of product size within overall geometric limitations;

3) The method is capable of using automatic electrical or electronic servos to move the roll pairs into a new configuration or the adjustments may be done manually. What is known as a flexible or CNC (computer numerical control) type of machine is therefore now possible.

Given that computer aided design (CAD) techniques are available for this technology, it is possible to determine the required position for each roll element on the machine within a few minutes, even for a product of a size/shape that has not been previously produced. If electronic servos are used then these servos will be able to move the roll elements and re-set the machine according to instruction given from a CAD system. It is therefore likely to be possible to comfortably change the overall roll geometry and re-set the machine for a new product within the pre-determined size range without removing or adding any rolls;

Moreover, to those familiar with the art of roll forming and modern control techniques, it will be obvious that tapered or otherwise non-uniform rolled sections (i.e. varying in width and/or profile along their length) may now be produced by using the present invention. Such sections will be able to be produced by adjusting the roll positions while rolling raw material under the control of electronic or other suitable control which synchronises the roll adjustments with raw material movement. The raw material for this purpose may be of either constant or varying width and/or cross-section.

4) The invention is applicable to a mill comprising a plurality of stands.

Embodiments of the present invention will now be described, by way of example with reference to the accompanying drawings. As regards FIGS. 5 to 8, they show only the right hand side of a roll stand for the sake of clarity. With the exception of under-mentioned items, in each case the drawings show an assembly that is mirrored about the Y axis indicated.

DESCRIPTION OF THE PREFERRED EMBODIMENTS

Figure 2:
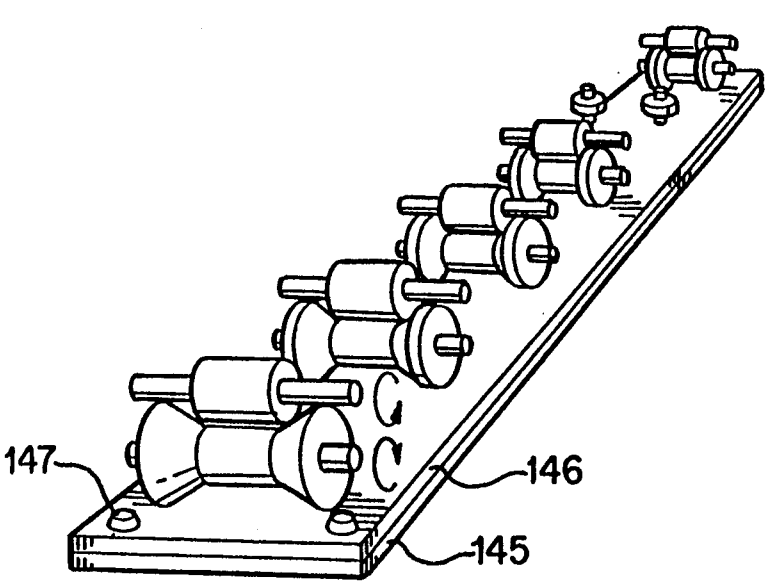
FIG. 2 PRIOR ART
FIG. 2 illustrates provision of a 'raft' in prior art apparatus.
Figure 1:
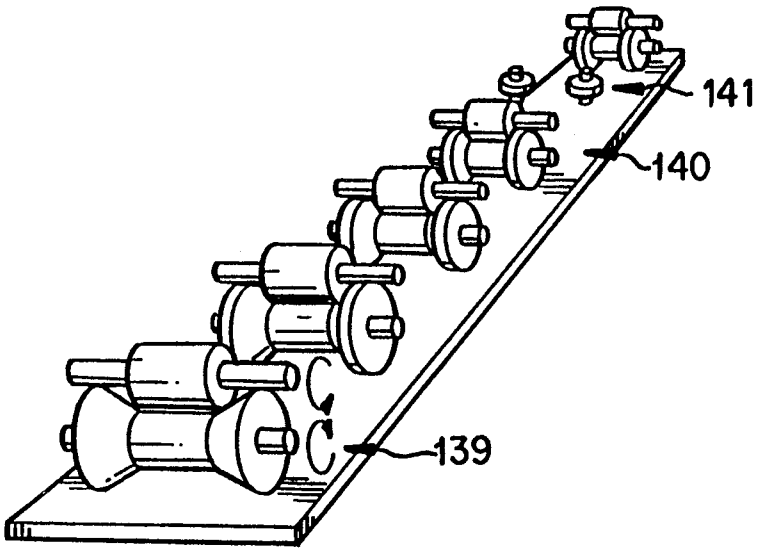
FIG. 1 PRIOR ART
FIG. 1 is a schematic illustration showing pairs of forming rolls in a conventional roll forming machine.
Figure 4:
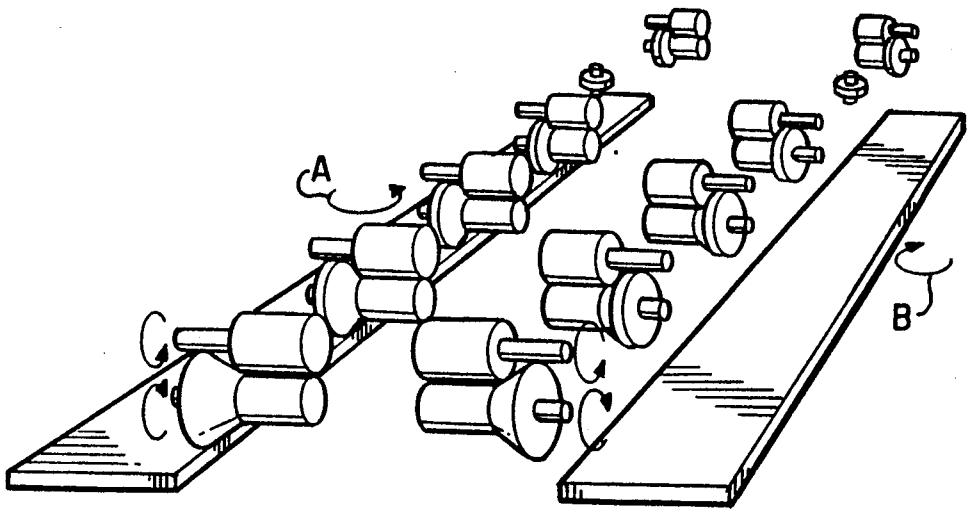
FIG. 4 PRIOR ART
FIG. 4 illustrates provision of two 'heads' in prior art apparatus.
Figure 3:
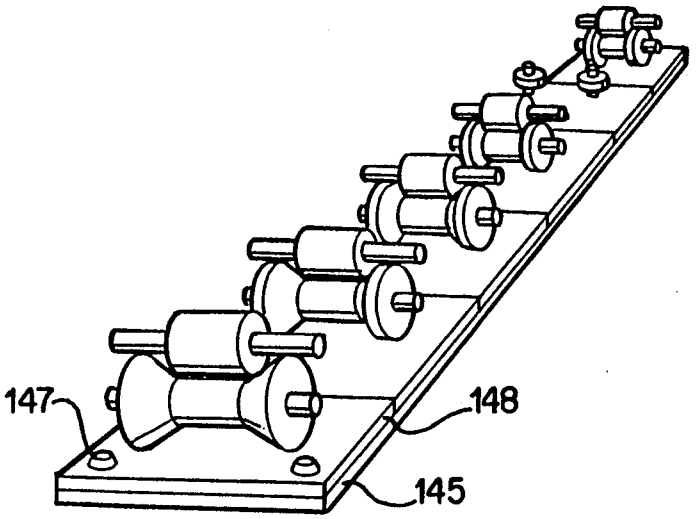
FIG. 3 PRIOR ART
FIG. 3 illustrates provision of a 'cassette' in prior art apparatus.
Figure 5:
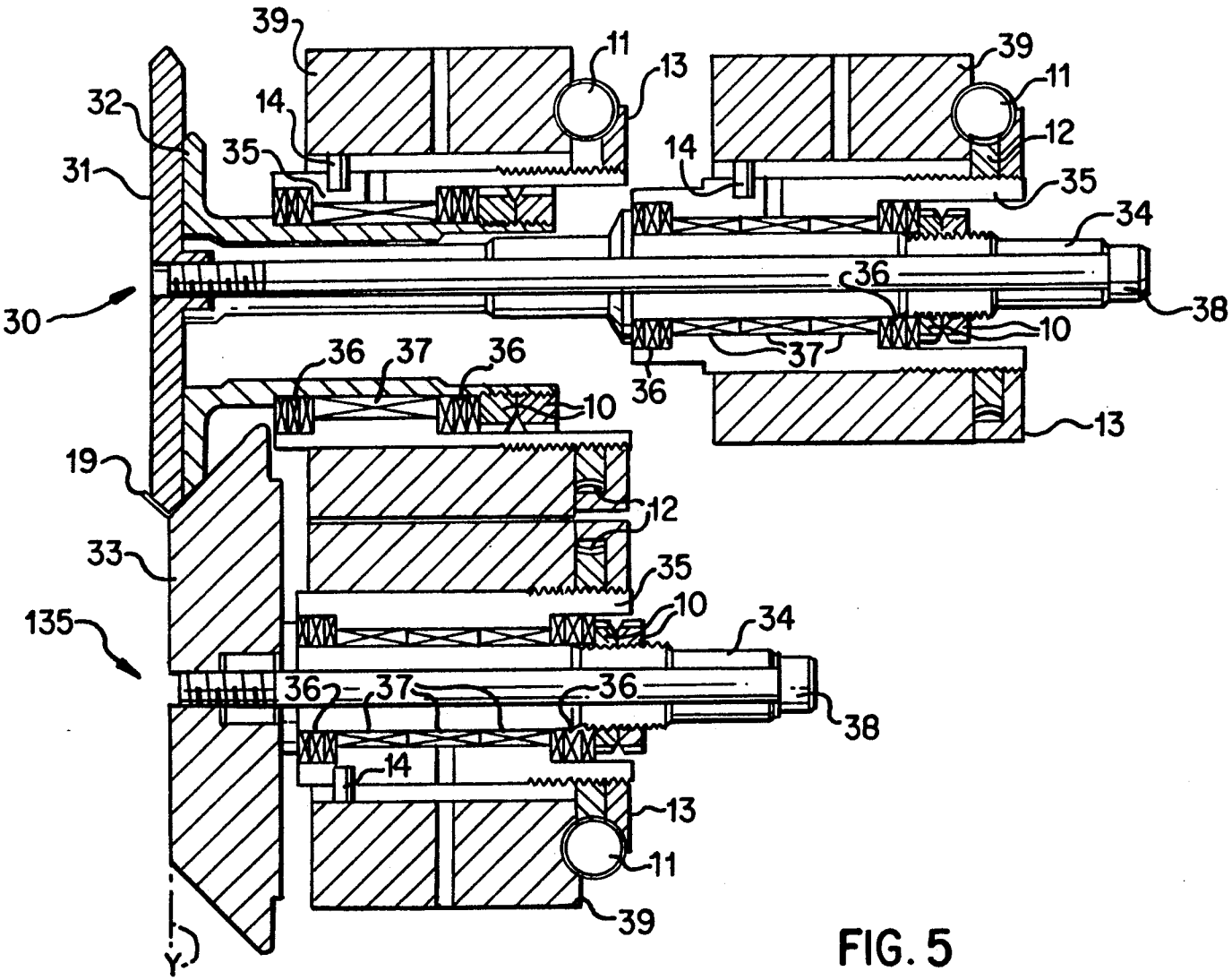
FIG. 5 shows a diagrammatic end elevation of a roll pair according to an embodiment of the present invention, fitted with tip and bottom rolls that are capable of forming a variety of angle shapes with the surface of the paper being in the plane of the roll pair.

Referring to FIG. 5, a top forming roll designating generally 30 comprises a roll element 31 mounted on a shaft 34 adjacent to a second forming roll element 32. (Item 31 is the sole item in the drawing not to be mirrored about the Y axis indicated.) A coupling or a sprocket or gear or other driving mechanism can be mounted onto the shaft 34, for the purposes of providing rotation if required. The roll pair also includes a bottom forming roll 35 having an element 33 mounted thereon in a similar fashion, to suitably assist the forming of the raw material 19. A sleeve 35 provides the rotatable mounting for bearings 36 and 37 which support the shafts 34. The use of a draw bolt 38 is one example of a means of positively mounting element 31 onto the shaft 34 at the same time as allowing a change of a top or bottom forming roll in the roll pair.

Mounting blocks 39 provide for vertical support of the top and bottom roll assemblies at the same time as allowing the aforementioned sleeve 35 to be adjusted in position laterally by the under-mentioned servo mechanism. A similar servo mechanism (not shown) is provided for the positional adjustment of the block 39 of pillars (shown in FIG. 7 only as item 16). Nuts 10 retain the sleeves 35 and roll 32 in the bearings 36 & 37. The roll elements 31 and 32 are thus rotatable to assist both in folding/forming raw material 19 and element 31 in transmitting drive thereto.

One example of automatically adjusting the lateral position of roll elements is given as follows. A servo subassembly is made up of a wheel 11, suitably connected to a servo motor (not shown), which drives a worm 12 mounted between the block 39 and lateral locator 13. The internal threads in the worm 12 engage an external thread on the sleeve 35. Rotation of the servo motor under the command of a numerical or computer control (not shown, but familiar to those skilled in the art of computer or automated control) thus permits the bottom forming roll 135 and thus its component element to be accurately positioned laterally. A peg 14 mounted the sleeve 35 and sliding laterally in a key way in the block 39 prevents rotation of the sleeve and therefore inaccuracies in positionally.

Thus, in use, element 31 may be displaced axially/laterally relative to elements 32 by a desired distance within a predetermined range. Variation of this distance between such adjacent elements 31, 32 allows variation in roll pair profile and thus in degree of folding of raw material 19. (This will be apparent form comparison of position of elements 31 and 32 in FIGS. 5 and 6 respectively).

Figure 6:
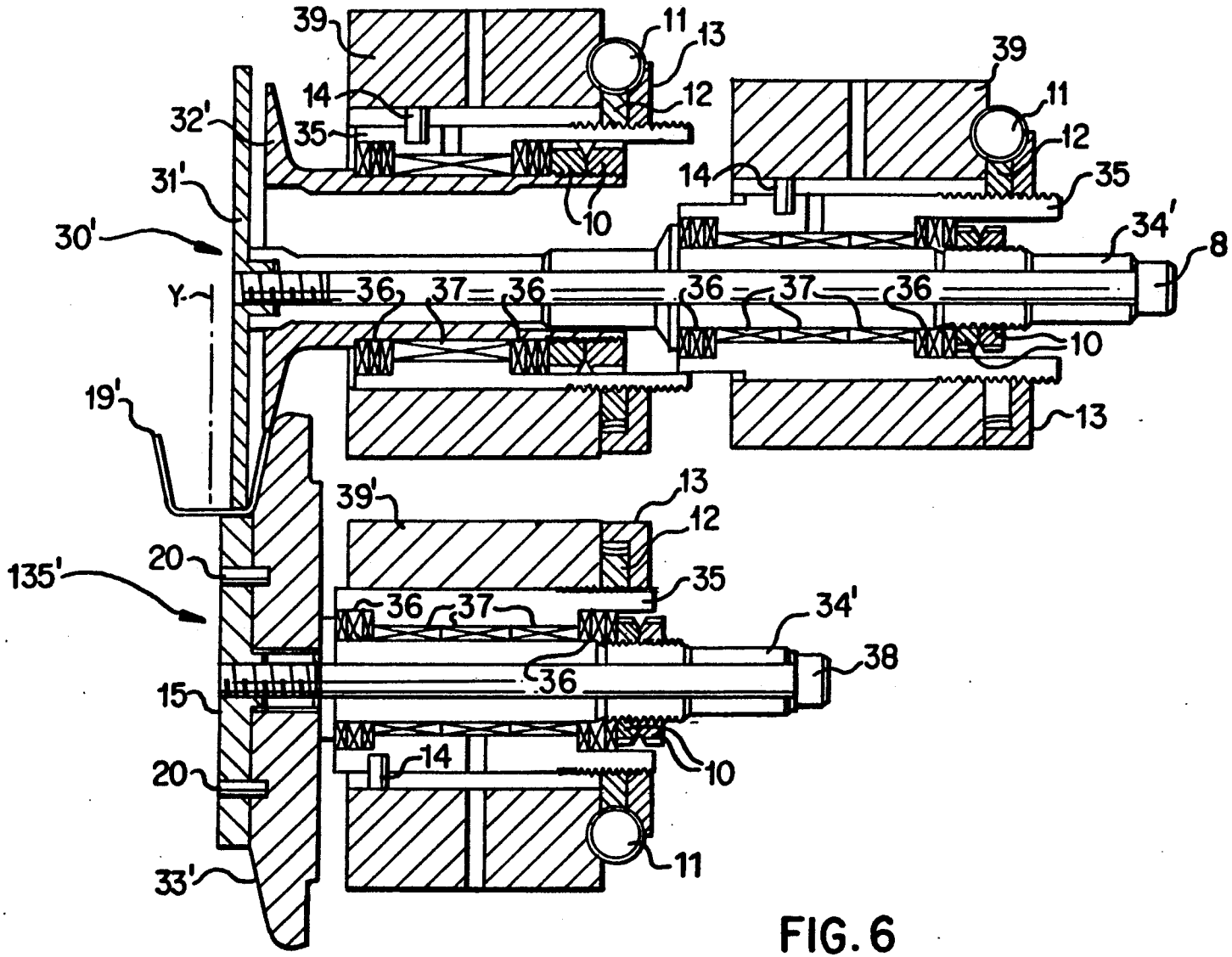
FIG. 6 shows a diagrammatic end elevation of a roll pair according to another embodiment, fitted with top and bottom rolls that are capable of forming a variety of channel shapes.

FIG. 6 shows apparatus of similar type to FIG. 5. In detail however, a differently shaped top forming roll designated generally 30' and its component elements 31' and 32' are mounted to deal with a different range of formed shapes 19'. In addition, item 15 is a further roll element suitably mounted to a bottom roll 135' by keys 20 and retained by bolts. Addition of element 15 to roll 135' improves versatility of roll 135' by altering the degrees of folding effected by it and by supporting the horizontal base of formed material 19'.

Figure 7:
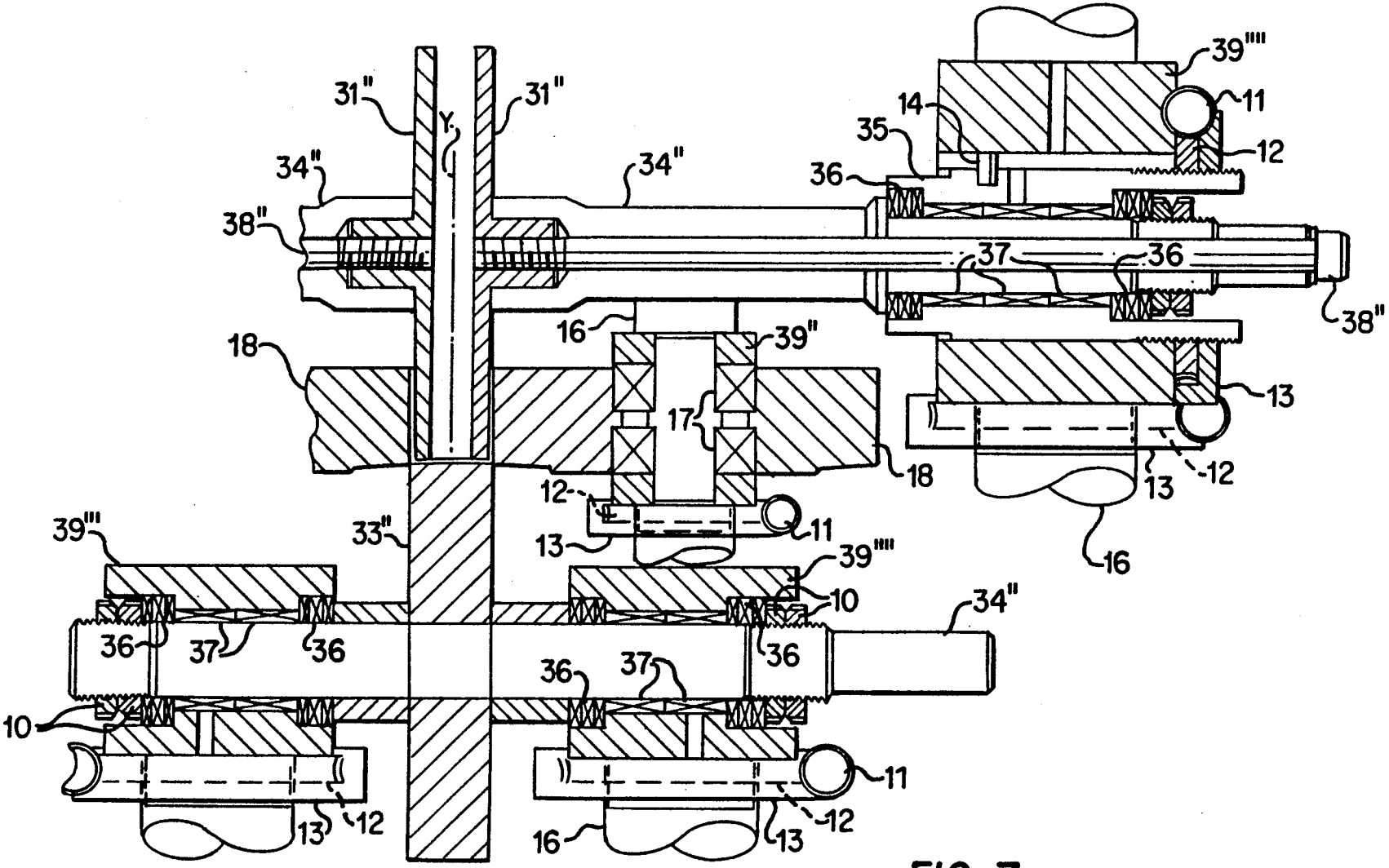
FIG. 7 shows a diagrammatic end elevation of a roll pair according to another embodiment, fitted with top and bottom rolls that are capable of forming a variety of channel shapes, at a later stage of the forming process.

FIG. 7 shows a suitable configuration for use in one of the last stages of forming a channel shape in a raw material 19. (Not all the items must be mirrored about the axis Y as in the lower forming roll 33'' and lower shaft 34''). In this illustration, a generally vertically mounted forming roll 18, running on bearings 17 shows how it may be desirable to use the same principle as previously discussed but having the axis of the forming roll rotated by about 90° in order to reduce scuffing of the roll against the raw material and/or gain access to certain parts of raw material when forming a less straight forward type of shape. General advantages of vertically mounted forming or 'auxiliary' rolls were described in relation to FIGS. 1 to 4.

Thus, the assemblies shown may also be mounted rotatably (not shown) with a similar servo mechanism as described above with the object of rotating the forming roll axis to a convenient position in a way that is clear to those familiar with the art of roll forming.

Figure 8:
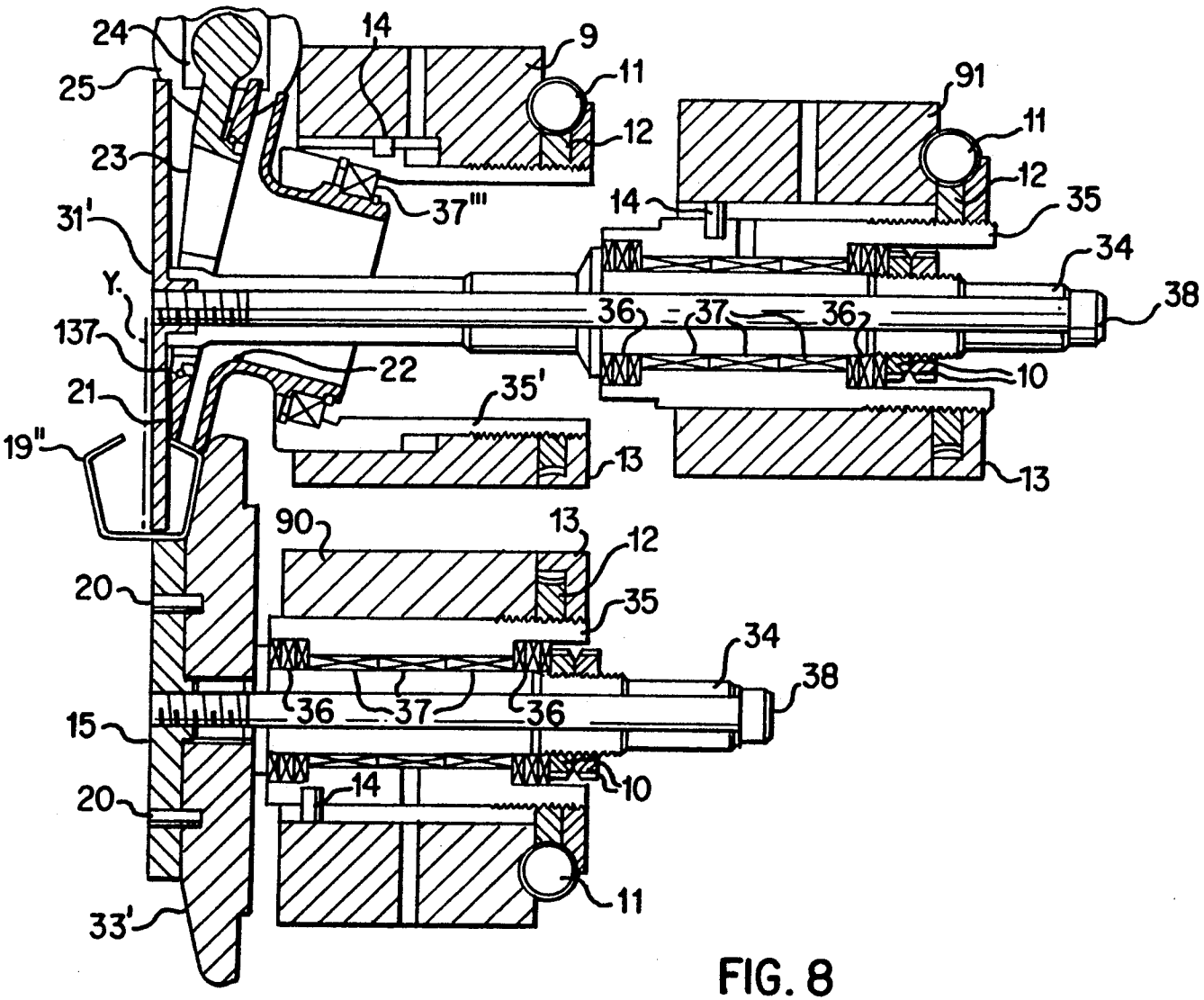
FIG. 8 shows a diagrammatic end elevation of a roll stand according to another embodiment.

Turning now to FIG. 8, this shows a suitable configuration for use in one of the stages of forming a box section in raw material 19''. In this embodiment, all items are mirrored about the Y axis. It is similar to the arrangement shown in FIG. 6 except that some auxiliary rolls 21 and 22 are included to assist in controlling the lip of the raw material edge.

These auxiliary rolls are mounted at the desired angle with respect to forming roll element 31'. Auxiliary roll 22 is arranged at a fixed angle, mounted in bearing 37''' on sleeve 35'. It is free to be moved as appropriate with respect to both the X and Y axes. Roll 21 differs in that it is mounted in a bearing 137 on a support 23. Support 23 is in turn mounted in support 24, which is free to be moved in the X and Y axes in a manner as previously described on slides and servos which are out of view. In addition, wheel 25 is effective to rotate the support 23 in the X-Y plane. The angle of roll 21 may thus be altered as well as its position with respect to the X and Y axes.

In the present invention various means may be employed to effect and control positioning of the forming and auxiliary rolls. It will be appreciated that, in the present context, the word "servo" is intended to include any physical means of movements carried out according to electronic, pneumatic, hydraulic, electrical or some other intermediary medium for instructions.

I claim:

1. A roll forming machine for forming material, which machine comprises pairs of rolls, respective pairs of said rolls being spaced apart along a material feed path and at least some of the rolls having different material roll forming profiles and arranged so that, in use, the machine is capable of effecting progressive folding of material fed between pairs of rolls along said path, characterized by at least one roll pair having a plurality of roll section elements in one roll of said at least on roll pair, wherein at least one of said roll section elements rotates about an axis in or near to the plane of the one roll of the at least one roll pair axis independently of the other roll section elements and wherein said at least one of said roll section elements is capable of positional adjustment by remote means to alter the profile of said at least one roll pair, such that said at least one roll section elements may be moved along said axis and at an angle to said axis into various positions for the purpose of altering the forming roll profile.

2. A roll forming machine according to claim 1 which includes means for rotationally driving at least one roll element to assist movement of material through the machine.

3. A roll forming machine according to claim 2, wherein the driving means are operable to selectively drive alternative roll elements.

4. A roll forming machine according to claim 3 wherein the driving means are operable to selectively drive alternative roll elements at different speeds.

5. A roll forming machine according to any one claims 2 or 3 or 4 wherein the driving means are operable to drive at least roll elements arranged medially of the roll.

6. A roll forming machine according to claim 1 or 2 wherein each roll element is selectively capable of free rotation and driven rotation within the plane of the roll pair.

7. A roll forming machine according to claim 1 or 2 or 3 or 4 wherein at least one of the roll elements is linearly displaceable within or near to, the plane of the roll pair independently of other roll elements.

8. A roll forming machine according to claim 7 which includes a means for selectively effecting linear displacement of alternative roll elements.

9. A roll forming machine according to claim 7 which includes a means for selectively effecting rotational displacement of alternative roll elements.

* * * * *